US009035841B2

(12) United States Patent
Wong et al.

(10) Patent No.: US 9,035,841 B2
(45) Date of Patent: May 19, 2015

(54) COMMUNICATION ELECTRONIC DEVICE AND ANTENNA STRUCTURE THEREOF

(75) Inventors: Kin-Lu Wong, New Taipei (TW); Wun-Jian Lin, New Taipei (TW)

(73) Assignee: ACER INCORPORATED, Xizhi Dist. New Taipei (TW)

( * ) Notice: Subject to any disclaimer, the term of this patent is extended or adjusted under 35 U.S.C. 154(b) by 718 days.

(21) Appl. No.: 13/115,999

(22) Filed: May 26, 2011

(65) Prior Publication Data

US 2012/0256802 A1 Oct. 11, 2012

(30) Foreign Application Priority Data

Apr. 8, 2011 (TW) ..... 100112294 A

(51) Int. Cl.

| | |
|---|---|
| ***H01Q 13/10*** | (2006.01) |
| ***H01Q 1/22*** | (2006.01) |
| ***H01Q 5/00*** | (2006.01) |
| ***H01Q 21/30*** | (2006.01) |

(52) U.S. Cl.

CPC ..... *H01Q 1/2266* (2013.01); *H01Q 5/0072* (2013.01); *H01Q 13/106* (2013.01); *H01Q 21/30* (2013.01)

(58) Field of Classification Search

USPC ..... 343/767–771

See application file for complete search history.

(56) References Cited

U.S. PATENT DOCUMENTS

| | | | | |
|---|---|---|---|---|
| 2005/0200545 | A1 | 9/2005 | Bancroft | |
| 2009/0153409 | A1 | 6/2009 | Chiang | |
| 2009/0153411 | A1 * | 6/2009 | Chiang et al. | 343/702 |
| 2010/0073242 | A1 * | 3/2010 | Ayala Vazquez et al. | 343/702 |

FOREIGN PATENT DOCUMENTS

| | | | |
|---|---|---|---|
| CN | 1930731 | A | 3/2007 |
| CN | 1947446 | A | 4/2007 |
| CN | 201191648 | Y | 2/2009 |
| CN | 100556165 | C | 10/2009 |
| CN | 101662067 | A | 3/2010 |
| EP | 2 157 659 | A1 | 2/2010 |

* cited by examiner

*Primary Examiner* — Matthew Mikels

(74) *Attorney, Agent, or Firm* — Winston Hsu; Scott Margo

(57) ABSTRACT

A communication electronic device which comprises a grounding element and a slot antenna is provided. The slot antenna is formed by a feeding element, a first slot, a second slot, and a third slot. The first slot is an open slot, which has an open end at the first side edge and a closed end extended toward the interior of the electrical conductor. The second slot is an open slot, which also has an open end at the first side edge and a closed end extended toward the interior of the electrical conductor. The second slot is substantially parallel to the first slot and is closer than the first slot to the grounding element. The third slot is a closed slot, whose two closed ends are all in the interior of the electrical conductor. The third slot is aligned between the first slot and the second slot.

16 Claims, 4 Drawing Sheets

COMMUNICATION ELECTRONIC DEVICE AND ANTENNA STRUCTURE THEREOF

BACKGROUND OF THE INVENTION

1. Field of the Invention

The present invention relates to a communication electronic device, and more particularly, to a tablet computer device with a multiband slot antenna.

2. Description of the Prior Art

With the progress of wireless technology and wireless market, human's demands for wireless communication are changing. Traditional notebooks are gradually replaced by thinner and more user-friendly tablet PCs, which can be easily carried by consumers. The tablet PC not only has normal voice transmissions but also has built-in multimedia applications that require large and rapid upload and download. For this reason, the data transmission speed of wireless communication has become one of the key points. Previous 3G antenna design cannot meet requirements of the data transmission speed, and thus the mobile communication systems go forward to 4G standard which has a large improvement in the data transmission speed. In order to achieve such a goal, the requirements of antenna design are to increase the higher-band bandwidth and the lower-band bandwidth of the operating band originally covering the WWAN (wireless wide area network) operation to cover the LTE (long term evolution) operation, which is indeed a great challenge for antenna designers.

Hence, how to provide a communication electronic device (such as, a tablet PC) with two wide operating bands at least covering from about 704 MHz to 960 MHz and from about 1710 MHz to 2690 MHz to satisfy the eight-band LTE/WWAN operation has become an important topic in this field.

SUMMARY OF THE INVENTION

It is one of the objectives of the present invention to provide a communication electronic device and a related antenna structure to solve the abovementioned problems. By using innovative combinations of a plurality of slots in a built-in antenna, the plurality of slots can be tightly integrated in order to reduce the size of the antenna. Moreover, the plurality of slots will not affect each other, such that the operating bandwidth and the radiation efficiency of the antenna won't be affected.

According to an aspect of the present invention, a communication electronic device comprising an antenna structure is provided. The antenna structure may include a grounding element and a slot antenna. The slot antenna is disposed on an electrical conductor being electrically connected to the grounding element. The slot antenna may include a feeding element, a first slot, a second slot, and a third slot. Herein a feeding point of the feeding element is electrically connected to a signal source being disposed on the grounding element. The first slot is an open slot, and has an open end located at a first side edge of the electrical conductor and a closed end extended toward the interior of the electrical conductor. The second slot is an open slot, and has an open end located at the first side edge of the electrical conductor and a closed end extended toward the interior of the electrical conductor, wherein the second slot is substantially parallel to the first slot and is closer than the first slot to the grounding element. The third slot is a closed slot, and has two closed ends located in the interior of the electrical conductor, wherein the third slot is aligned between the first slot and the second slot.

According to an aspect of the present invention, an antenna structure is provided. The antenna structure may include a grounding element and a slot antenna. The slot antenna is disposed on an electrical conductor being electrically connected to the grounding element. The slot antenna may include a feeding element, a first slot, a second slot, and a third slot. Herein a feeding point of the feeding element is electrically connected to a signal source being disposed on the grounding element. The first slot is an open slot, and has an open end located at a first side edge of the electrical conductor and a closed end extended toward the interior of the electrical conductor. The second slot is an open slot, and has an open end located at the first side edge of the electrical conductor and a closed end extended toward the interior of the electrical conductor, wherein the second slot is substantially parallel to the first slot and is closer than the first slot to the grounding element. The third slot is a closed slot, and has two closed ends located in the interior of the electrical conductor, wherein the third slot is aligned between the first slot and the second slot.

In one embodiment of the present invention, the electrical conductor may be a metal surface disposed upon a substrate.

In one embodiment of the present invention, the feeding element of the slot antenna further comprises a microstrip feedline being disposed on another surface of the substrate, which is opposite to the metal surface of the substrate; and the microstrip feedline sequentially passes through the first slot, the third slot, and the second slot, and is used for exciting the slot antenna.

In another embodiment of the present invention, the feeding element of the slot antenna further comprises a microstrip feedline being disposed on another surface of the substrate, which is opposite to the metal surface of the substrate; and the microstrip feedline comprises a main feeding strip sequentially passing through the first slot, the third slot, and the second slot as well as a branch feeding strip sequentially passing through the first slot and the third slot, and is used for exciting the slot antenna.

In one embodiment of the present invention, the first slot can be used for exciting a quarter-wavelength resonant mode at lower frequencies. Since the first slot is printed on the substrate, its length must be smaller than quarter wavelength of the lowest operating frequency of the slot antenna. In addition, the third slot is used for exciting a half-wavelength resonant mode at lower frequencies. Since the third slot is printed on the substrate, its length must be smaller than half wavelength of the lowest operating frequency of the slot antenna. Then, these two lower-frequency resonant modes can be combined to form a wide first (lower-frequency) operating band covering the three-band LTE700/GSM850/900 operation (from about 704 MHz to 960 MHz). In addition, the second slot can be used for exciting a quarter-wavelength resonant mode at higher frequencies, and its length must be larger than quarter wavelength of the highest operating frequency of the slot antenna. Then, such a resonant mode as well as the higher-order resonant modes of the third slot can be combined to form a wide second (higher-frequency) operating band covering the five-band GSM1800/1900/UMTS/LTE2300/2500 operation (from about 1710 MHz to 2690 MHz). The core value of the present invention is to make three independent slots to have good excitation even if they are inseparably close to each other. The principle of the communication electronic device and its antenna structure is that: one of the three slots (i.e., the third slot) is a closed slot and is aligned between the first slot and the second slot each being an open slot, respectively. In the prior art, if all of the three slots are open slots, the strongest electric field distribution will be near their open ends when the slots are radiating. For this reason, the three open slots will be unable to achieve an optimum impedance matching and a wideband operation due to mutual interference between strong electric fields. In the present invention, since a closed slot is aligned between two open slots, the closed slot can effectively reduce the mutual interference between strong electric fields of the two open slots. Therefore, the antenna structure of the present invention is capable of successfully exciting the wide first (lower-frequency) operating band and the wide second (higher-frequency) operating band covering the eight-band LTE/WWAN operation.

These and other objectives of the present invention will no doubt become obvious to those of ordinary skill in the art after reading the following detailed description of the preferred embodiment that is illustrated in the various figures and drawings.

DETAILED DESCRIPTION

The following description is of the best-contemplated mode of carrying out the present invention. A detailed description is given in the following embodiments with reference to the accompanying drawings.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
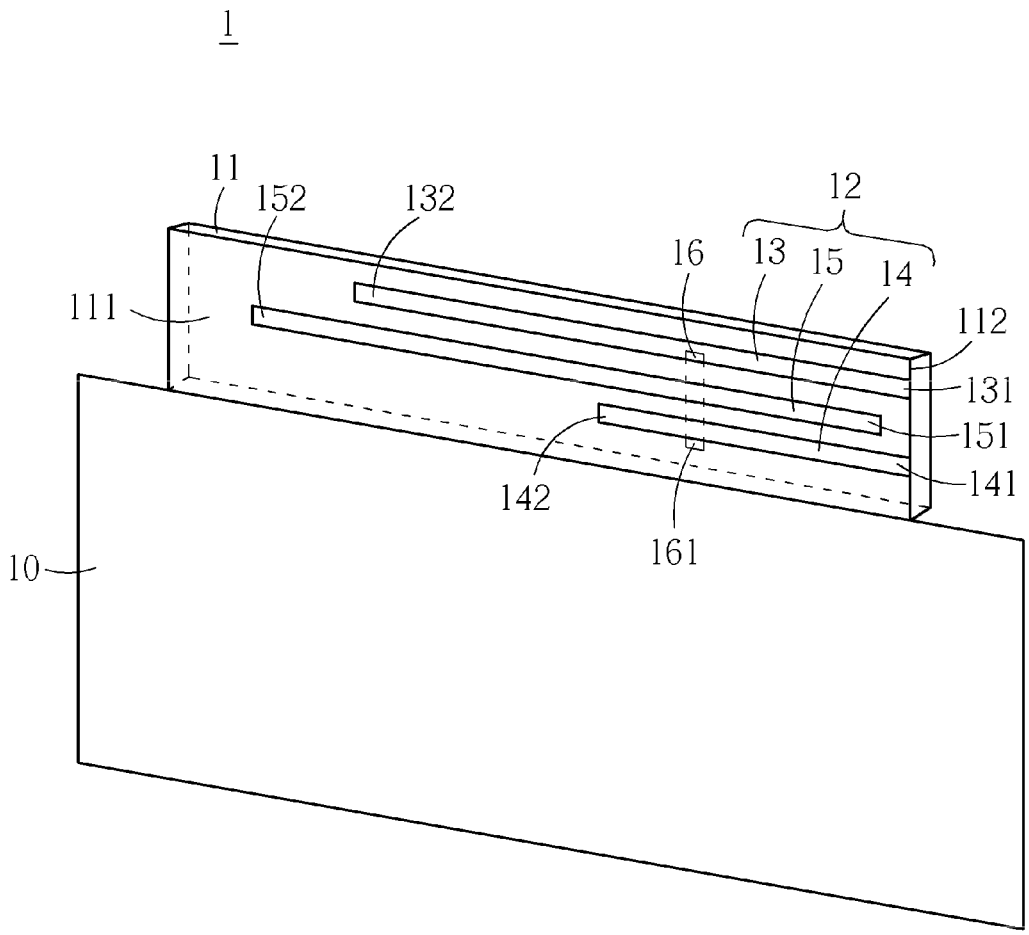
FIG. 1 is a diagram illustrating a communication electronic device and an antenna structure disposed therein according to a first embodiment of the present invention.

Please refer to FIG. 1. FIG. 1 is a diagram illustrating a communication electronic device and an antenna structure disposed therein according to a first embodiment of the present invention. In this embodiment, the communication electronic device 1 may include an antenna structure, wherein the antenna structure may include a grounding element 10 and a slot antenna 12. The slot antenna 12 is disposed on an electrical conductor 111. In this embodiment, the electrical conductor 111 is implemented by a metal surface disposed upon a substrate 11, and the substrate 11 has a first side edge 112 which is substantially perpendicular to the grounding element 10. However, the present invention is not limited to this only, and the electrical conductor can be implemented by other materials with electrical conductivity. As shown in FIG. 1, the slot antenna 12 at least include, but is not limited to, a feeding element 16, a first slot 13, a second slot 14, and a third slot 15. The first slot 13 is an open slot and includes an open end 131 and a closed end 132, wherein the open end 131 is located at the first side edge 112 of the electrical conductor 111, and the closed end 132 is extended toward the interior of the electrical conductor 111. The second slot 14 is an open slot and includes an open end 141 and a closed end 142, wherein the open end 141 is located at the first side edge 112 of the electrical conductor 111, and the closed end 142 is extended toward the interior of the electrical conductor 111. Besides, the second slot 14 is substantially parallel to the first slot 13 and is closer than the first slot 13 to the grounding element 10. The third slot 15 is a closed slot and includes two closed ends 151 and 152, and both of the two closed ends 151 and 152 are in the interior of the electrical conductor 111. The third slot 15 is aligned between the first slot 13 and the second slot 14. Moreover, in this embodiment, the feeding element 16 may be implemented by a microstrip feedline being disposed on another surface of the substrate 11, which is opposite to electrical conductor 111 (i.e., the metal surface) of the substrate 11. Be noted that: the microstrip feedline 16 sequentially passes through the first slot 13, the third slot 15, and the second slot 14, and is used for exciting the slot antenna 12. In addition, the microstrip feedline 16 further includes a feeding point 161 electrically connected to a signal source (not shown) being disposed on the grounding element 10, such that signals can be fed through the feeding point 161.

What calls for special attention is that: in this embodiment, a length of the first slot 13 is smaller than quarter wavelength of the lowest operating frequency of the slot antenna 12; a length of the second slot 14 is larger than quarter wavelength of the highest operating frequency of the slot antenna 12; and a length of the third slot 15 is smaller than half wavelength of the lowest operating frequency of the slot antenna 12.

Figure 2:
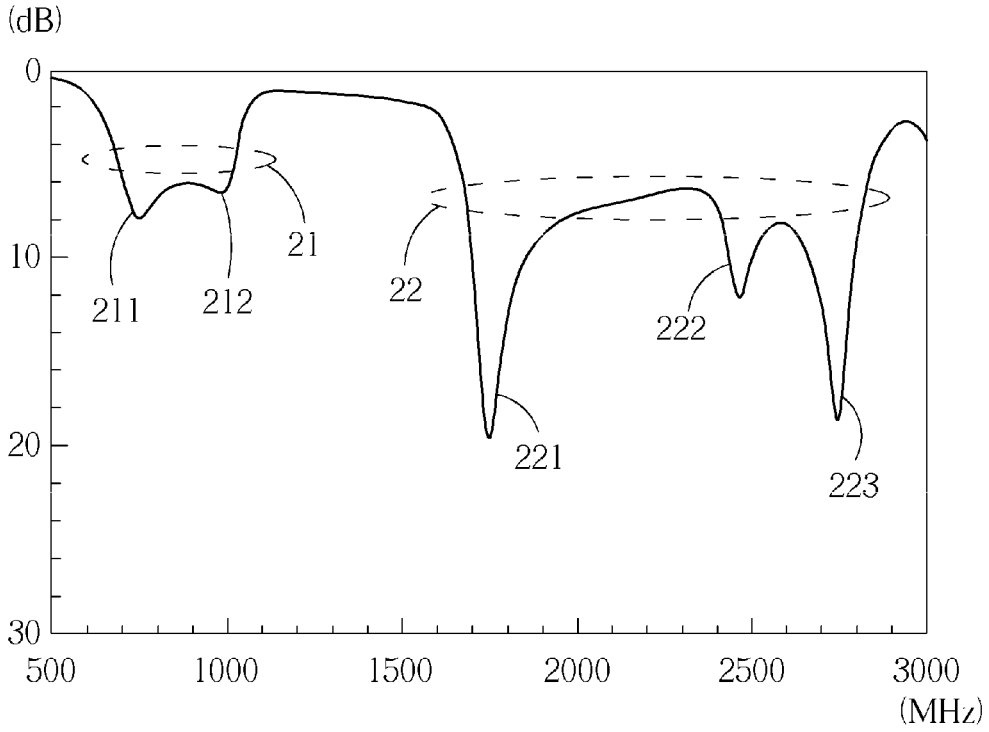
FIG. 2 is a diagram illustrating the return loss of the communication electronic device and the antenna structure disposed therein according to a first embodiment of the present invention.

Please refer to FIG. 1 together with FIG. 2. FIG. 2 is a diagram illustrating the return loss of the communication electronic device and the antenna structure disposed therein according to a first embodiment of the present invention. In this embodiment, the size of the communication electronic device 1 is as follows: the grounding element 10 has a length of 200 mm and a width of 150 mm; the substrate 11 has a length of 75 mm, a width of 15 mm, and a thickness of 0.8 mm; the length of the first slot 13 is approximately 56 mm; the length of the second slot 14 is approximately 32 mm; and the length of the third slot 15 is approximately 88 mm. The first slot 13 and the third slot 15 are respectively used for exciting a quarter-wavelength resonant mode 211 and a half-wavelength resonant mode 212, and then these two resonant modes 211 and 212 can be combined to form a wide first (lower-frequency) operating band (such as, the first operating band 21 shown in FIG. 2). The second slot 14 is used for exciting a quarter-wavelength resonant mode 221, and then the resonant mode 221 as well as the higher-order resonant modes 222 and 223 of the third slot 15 can be combined to form a wide second (higher-frequency) operating band (such as, the second operating band 22 shown in FIG. 2). Under a 6-dB return-loss definition, the first operating band 21 may cover the three-band LTE700/GSM850/900 operation (from about 704 MHz to 960 MHz), and the second operating band 22 may cover the five-band GSM1800/1900/UMTS/LTE2300/2500 operation (from about 1710 MHz to 2690 MHz), thereby the antenna structure can satisfy requirements of the eight-band LTE/WWAN operation.

Figure 3:
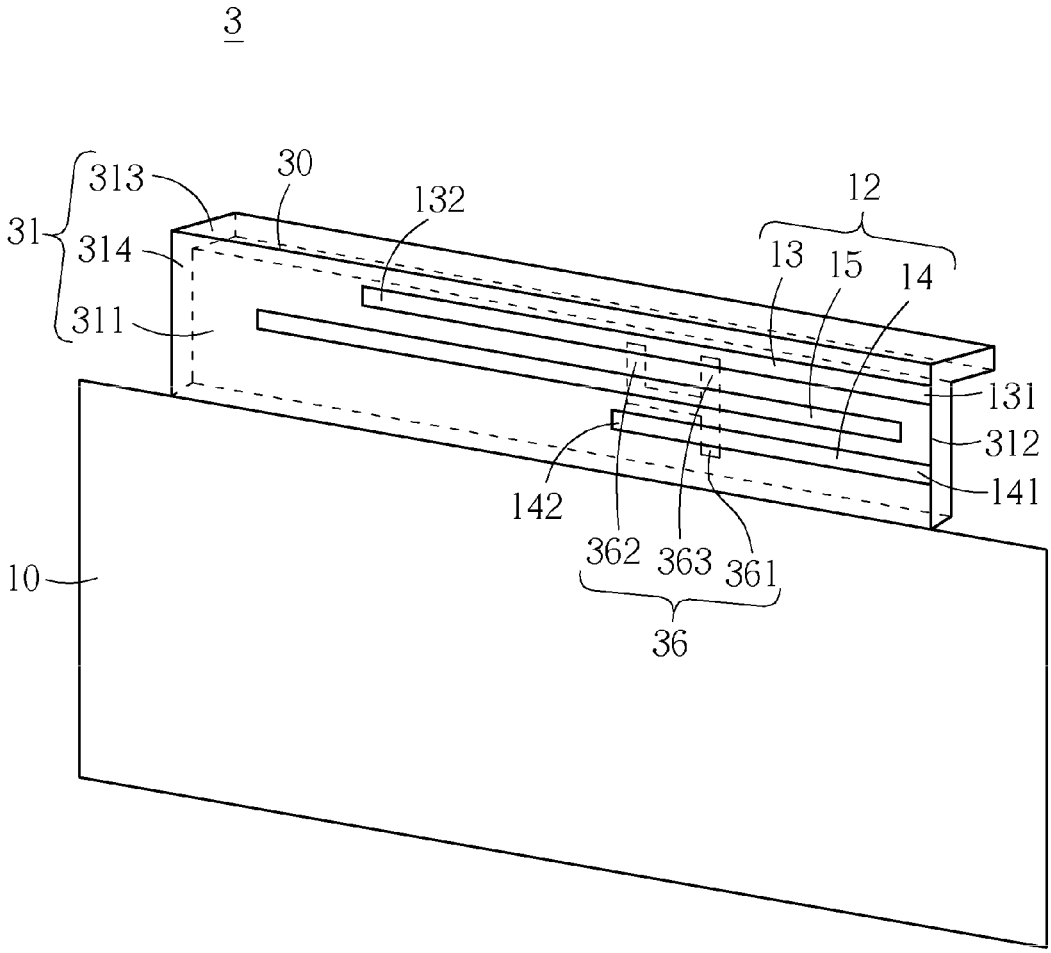
FIG. 3 is a diagram illustrating a communication electronic device and an antenna structure disposed therein according to a second embodiment of the present invention.

Please refer to FIG. 3. FIG. 3 is a diagram illustrating a communication electronic device 3 and an antenna structure disposed therein according to a second embodiment of the present invention. The structure of the communication electronic device 3 shown in the second embodiment is similar to that of the communication electronic device 1 shown in the first embodiment, and the difference between them is that: a substrate 31 of the communication electronic device 3 is bent by a bending line, and a feeding element 36 of the slot antenna of the communication electronic device 3 is implemented by a two-branch microstrip feedline, which includes a main feeding strip 363 and a branch feeding strip 362. As shown in FIG. 3, the substrate 31 includes a first partial section 313 and a second partial section forming 314 an L shape, wherein the first partial section 313 of the substrate 31 having the slot antenna is parallel to the grounding element 10, and the second partial section 314 of the substrate 31 is substantially perpendicular to the grounding element 10. Furthermore, in this embodiment, the feeding element 36 (being implemented by a two-branch microstrip feedline) has a main feeding strip 363 sequentially passing through the first slot 13, the third slot 15, and the second slot 14 as well as a branch feeding strip 362 sequentially passing through the first slot 13 and the third slot 15, and is used for exciting the slot antenna 12. In details, not only can the branch feeding strip 362, with the main feeding strip 363, be used for co-exciting the slot antenna 12, but the branch feeding strip 362 can be used for adjusting the impedance matching through bending the branch feeding strip 362 or modifying the distance between the branch feeding strip 362 and the main feeding strip 363 in order to effectively excite the first slot 13 and the third slot 15. The second partial section 314 of the substrate 31 is substantially perpendicular to the grounding element 10, that is, the substrate 31 can be bent in the limited space, such that the space can be fully used without changing original characteristics of the slot antenna 12. Moreover, the structure of the communication electronic device 3 of the second embodiment is similar to that of the communication electronic device 1 of the first embodiment, and forms two similar wide operating bands covering the eight-band LTE/WWAN operation.

What calls for special attention is that: the feeding element 16 shown in the first embodiment is implemented by a single microstrip feedline; however, the feeding element 36 shown in the second embodiment is implemented by a two-branch microstrip feedline, wherein the branch feeding strip 362 of the two-branch microstrip feedline has a bend, such that the main feeding strip 363 and the branch feeding strip 362 of the feeding element 36 form an inverted h shape. This in no way should be considered as a limitation of the present invention. Those skilled in the art should appreciate that various modifications of the feeding element 16 and the feeding element 36 may be made without departing from the spirit of the present invention.

Figure 4:
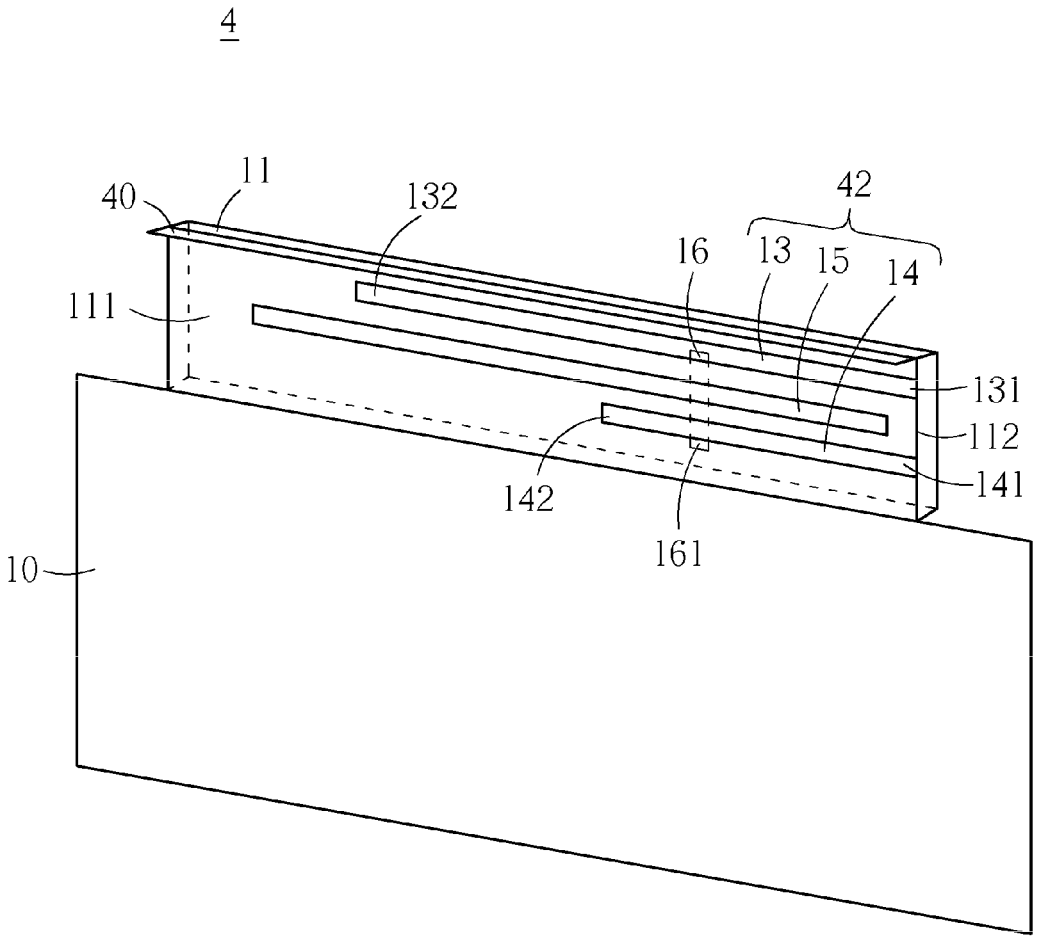
FIG. 4 is a diagram illustrating a communication electronic device and an antenna structure disposed therein according to a third embodiment of the present invention.

Please refer to FIG. 4. FIG. 4 is a diagram illustrating a communication electronic device 4 and an antenna structure disposed therein according to a third embodiment of the present invention. The structure of the communication electronic device 4 shown in the third embodiment is similar to that of the communication electronic device 1 shown in the first embodiment, and the difference between them is that: a slot antenna 42 of the communication electronic device 4 shown in FIG. 4 further includes an extended metal sheet 40 being electrically connected to the metal surface of the substrate 11, and the extended metal sheet 40 is substantially perpendicular to the grounding element 10. By adopting the extended metal sheet 40, the size of the slot antenna 42 can be reduced, and the overall operating bandwidth and radiation efficiency can be increased as well. Moreover, the structure of the communication electronic device 4 of the third embodiment is similar to that of the communication electronic device 1 of the first embodiment, and forms two similar wide operating bands covering the eight-band LTE/WWAN operation.

Undoubtedly, those skilled in the art should appreciate that various modifications of the communication electronic devices and the antenna structures shown in FIG. 1, FIG. 3, and FIG. 4 may be made without departing from the spirit of the present invention. In addition, the number of the bends of each slot (including the first slot 13, the second slot 14, and the third slot 15) is not limited, and the bending direction, the bending angle, and the bending shape of the bends should not be considered as a limitation of the present invention.

The abovementioned embodiments are presented merely to illustrate practicable designs of the present invention, and in no way should be considered to be limitations of the scope of the present invention. In summary, a communication electronic device and its antenna structure are provided, which has a slot antenna capable of forming two wide operating bands. Such antenna has a simple structure and can be applied to varied applications. Besides, the two operating bands of the antenna may cover the three-band LTE700/GSM850/900 operation (from about 704 MHz to 960 MHz) and the five-band GSM1800/1900/UMTS/LTE2300/2500 operation (from about 1710 MHz to 2690 MHz), respectively, thereby covering operating bands of all mobile communication systems at present.

While the present invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

Those skilled in the art will readily observe that numerous modifications and alterations of the device and method may be made while retaining the teachings of the invention.

What is claimed is:

1. A communication electronic device comprising an antenna structure, the antenna structure comprising:

a grounding element; and a slot antenna, disposed on an electrical conductor being electrically connected to the grounding element, the slot antenna comprising:

a feeding element, wherein a feeding point of the feeding element is electrically connected to a signal source being disposed on the grounding element;

a first slot, the first slot being an open slot and having an open end located at a first side edge of the electrical conductor and a closed end extended toward the interior of the electrical conductor;

a second slot, the second slot being an open slot and having an open end located at the first side edge of the electrical conductor and a closed end extended toward the interior of the electrical conductor, wherein the second slot is substantially parallel to the first slot and is closer than the first slot to the grounding element; and a third slot, the third slot being a closed slot and having two closed ends located in the interior of the electrical conductor, wherein the third slot is aligned between the first slot and the second slot;

wherein the electrical conductor is a metal surface disposed upon a substrate, and the feeding element of the slot antenna further comprises a microstrip feedline being disposed on another surface of the substrate, which is opposite to the metal surface of the substrate; and the microstrip feedline comprises a main feeding strip sequentially passing through the first slot, the third slot, and the second slot as well as a branch feeding strip sequentially passing through the first slot and the third slot, and is used for exciting the slot antenna.

2. The communication electronic device according to claim 1, wherein the branch feeding strip of the microstrip feedline comprises a bend, such that the main feeding strip and the branch feeding strip of the microstrip feedline form an inverted h shape.

3. The communication electronic device according to claim 1, wherein a length of the first slot is smaller than quarter wavelength of the lowest operating frequency of the slot antenna.

4. The communication electronic device according to claim 1, wherein a length of the second slot is larger than quarter wavelength of the highest operating frequency of the slot antenna.

5. The communication electronic device according to claim 1, wherein a length of the third slot is smaller than half wavelength of the lowest operating frequency of the slot antenna.

6. The communication electronic device according to claim 1, wherein the substrate comprises a first partial section and a second partial section forming an L shape, the first partial section of the substrate having the slot antenna is parallel to the grounding element, and the second partial section of the substrate is substantially perpendicular to the grounding element.

7. The communication electronic device according to claim 1, wherein the slot antenna further comprises an extended metal sheet being electrically connected to the metal surface of the substrate, and the extended metal sheet is substantially perpendicular to the grounding element.

8. An antenna structure, comprising:

a grounding element; and a slot antenna, disposed on an electrical conductor being electrically connected to the grounding element, the slot antenna comprising:

a feeding element, wherein a feeding point of the feeding element is electrically connected to a signal source being disposed on the grounding element;

a first slot, the first slot being an open slot and having an open end located at a first side edge of the electrical conductor and a closed end extended toward the interior of the electrical conductor;

a second slot, the second slot being an open slot and having an open end located at the first side edge of the electrical conductor and a closed end extended toward the interior of the electrical conductor, wherein the second slot is substantially parallel to the first slot and is closer than the first slot to the grounding element; and a third slot, the third slot being a closed slot and having two closed ends located in the interior of the electrical conductor, wherein the third slot is aligned between the first slot and the second slot;

wherein the electrical conductor is a metal surface disposed upon a substrate, and the feeding element of the slot antenna further comprises a microstrip feedline being disposed on another surface of the substrate, which is opposite to the metal surface of the substrate; and the microstrip feedline comprises a main feeding strip sequentially passing through the first slot, the third slot, and the second slot as well as a branch feeding strip sequentially passing through the first slot and the third slot, and is used for exciting the slot antenna.

9. The antenna structure according to claim 8, wherein the branch feeding strip of the microstrip feedline comprises a bend, such that the main feeding strip and the branch feeding strip of the microstrip feedline form an inverted h shape.

10. The antenna structure according to claim 8, wherein a length of the first slot is smaller than quarter wavelength of the lowest operating frequency of the slot antenna.

11. The antenna structure according to claim 8, wherein a length of the second slot is larger than quarter wavelength of the highest operating frequency of the slot antenna.

12. The antenna structure according to claim 8, wherein a length of the third slot is smaller than half wavelength of the lowest operating frequency of the slot antenna.

13. The antenna structure according to claim 8, wherein the substrate comprises a first partial section and a second partial section forming an L shape, the first partial section of the substrate having the slot antenna is parallel to the grounding element, and the second partial section of the substrate is substantially perpendicular to the grounding element.

14. The antenna structure according to claim 8, wherein the slot antenna further comprises an extended metal sheet being electrically connected to the metal surface of the substrate, and the extended metal sheet is substantially perpendicular to the grounding element.

15. A communication electronic device comprising an antenna structure, the antenna structure comprising:

a grounding element; and a slot antenna, disposed on an electrical conductor being electrically connected to the grounding element, the slot antenna comprising:

a feeding element, wherein a feeding point of the feeding element is electrically connected to a signal source being disposed on the grounding element;

a first slot, the first slot being an open slot and having an open end located at a first side edge of the electrical conductor and a closed end extended toward the interior of the electrical conductor;

a second slot, the second slot being an open slot and having an open end located at the first side edge of the electrical conductor and a closed end extended toward the interior of the electrical conductor, wherein the second slot is substantially parallel to the first slot and is closer than the first slot to the grounding element; and a third slot, the third slot being a closed slot and having two closed ends located in the interior of the electrical conductor, wherein the third slot is aligned between the first slot and the second slot;

wherein the electrical conductor is a metal surface disposed upon a substrate, and the substrate comprises a first partial section and a second partial section forming an L shape, the first partial section of the substrate having the slot antenna is parallel to the grounding element, and the second partial section of the substrate is substantially perpendicular to the grounding element.

16. An antenna structure, comprising:

a grounding element; and a slot antenna, disposed on an electrical conductor being electrically connected to the grounding element, the slot antenna comprising:

a feeding element, wherein a feeding point of the feeding element is electrically connected to a signal source being disposed on the grounding element;

a first slot, the first slot being an open slot and having an open end located at a first side edge of the electrical conductor and a closed end extended toward the interior of the electrical conductor;

a second slot, the second slot being an open slot and having an open end located at the first side edge of the electrical conductor and a closed end extended toward the interior of the electrical conductor, wherein the second slot is substantially parallel to the first slot and is closer than the first slot to the grounding element; and a third slot, the third slot being a closed slot and having two closed ends located in the interior of the electrical conductor, wherein the third slot is aligned between the first slot and the second slot;

wherein the electrical conductor is a metal surface disposed upon a substrate, and the substrate comprises a first partial section and a second partial section forming an L shape, the first partial section of the substrate having the slot antenna is parallel to the grounding element, and the second partial section of the substrate is substantially perpendicular to the grounding element.

* * * * *